US009905907B2

(12) United States Patent
Wang et al.

(10) Patent No.: US 9,905,907 B2
(45) Date of Patent: Feb. 27, 2018

(54) HOUSING FOR ELECTRONIC DEVICE AND METHOD FOR MAKING SAME

(71) Applicants: SHENZHEN FUTAIHONG PRECISION INDUSTRY CO., LTD., Shenzhen (TW); FIH (HONG KONG) LIMITED, Kowloon (HK)

(72) Inventors: Yu-Tsai Wang, New Taipei (TW); Jing-Hai Zheng, Shenzhen (CN)

(73) Assignees: SHENZHEN FUTAIHONG PRECISION INDUSTRY CO., LTD., Shenzhen (CN); FIH (HONG KONG) LIMITED, Kowloon (HK)

( * ) Notice: Subject to any disclaimer, the term of this patent is extended or adjusted under 35 U.S.C. 154(b) by 43 days.

(21) Appl. No.: 14/842,375

(22) Filed: Sep. 1, 2015

(65) Prior Publication Data

US 2016/0294041 A1 Oct. 6, 2016

(30) Foreign Application Priority Data

Mar. 31, 2015 (CN) ..... 2015 1 0145737

(51) Int. Cl.
*H01Q 1/40* (2006.01)
*H01Q 1/24* (2006.01)
*C23C 24/04* (2006.01)

(52) U.S. Cl.
CPC ..... *H01Q 1/241* (2013.01); *C23C 24/04* (2013.01); *H01Q 1/40* (2013.01)

(58) Field of Classification Search
CPC ..... H01Q 1/241
USPC ..... 343/702
See application file for complete search history.

(56) References Cited

U.S. PATENT DOCUMENTS 8,709,335 B1 * 4/2014 Vlcek ..... B05B 7/1626 419/63
2008/0152926 A1 * 6/2008 Baikerikar ..... C08L 33/14 428/422.8
2010/0176118 A1 * 7/2010 Lee ..... H05B 3/34 219/549

FOREIGN PATENT DOCUMENTS

CN 203448260 U 2/2014
CN 204045726 U 12/2014
TW 200936012 A 8/2009
TW 201103190 A 1/2011

OTHER PUBLICATIONS

<<Introduction of challenges and ideas of designing an antenna>>.

* cited by examiner

*Primary Examiner* — Andrea Lindgren Baltzell
(74) *Attorney, Agent, or Firm* — ScienBiziP, P.C.

(57) ABSTRACT

The housing includes a base and an antenna coating layer. The base includes a first surface. The base is made of one of glass and ceramic. The antenna coating layer is formed on the first surface. The antenna coating layer is made of metal power. The metal power is selected from one of copper power, copper alloy power, or copper and nickel mixed power.

10 Claims, 5 Drawing Sheets

HOUSING FOR ELECTRONIC DEVICE AND METHOD FOR MAKING SAME

FIELD

The subject matter herein generally relates to housings for electronic devices, and particularly to a housing with an antenna coating layer for an electronic device.

BACKGROUND

Electronic devices commonly includes an antenna assembly configured for transmitting/receiving signals such as an antenna coating layer. The typical antenna coating layer can be an Laser Direct structuring (LDS) antenna coating layer, a double double-shot antenna coating layer, a printing antenna coating layer, and so on. However, considering cost of the antenna coating layer and development of the electronic devices tend to light and thin, the antenna coating layer mentioned-above cannot satisfy requirements of users.

BRIEF DESCRIPTION OF THE FIGURES

Implementations of the present technology will now be described, by way of example only, with reference to the attached figures.

DETAILED DESCRIPTION

Figure 1:
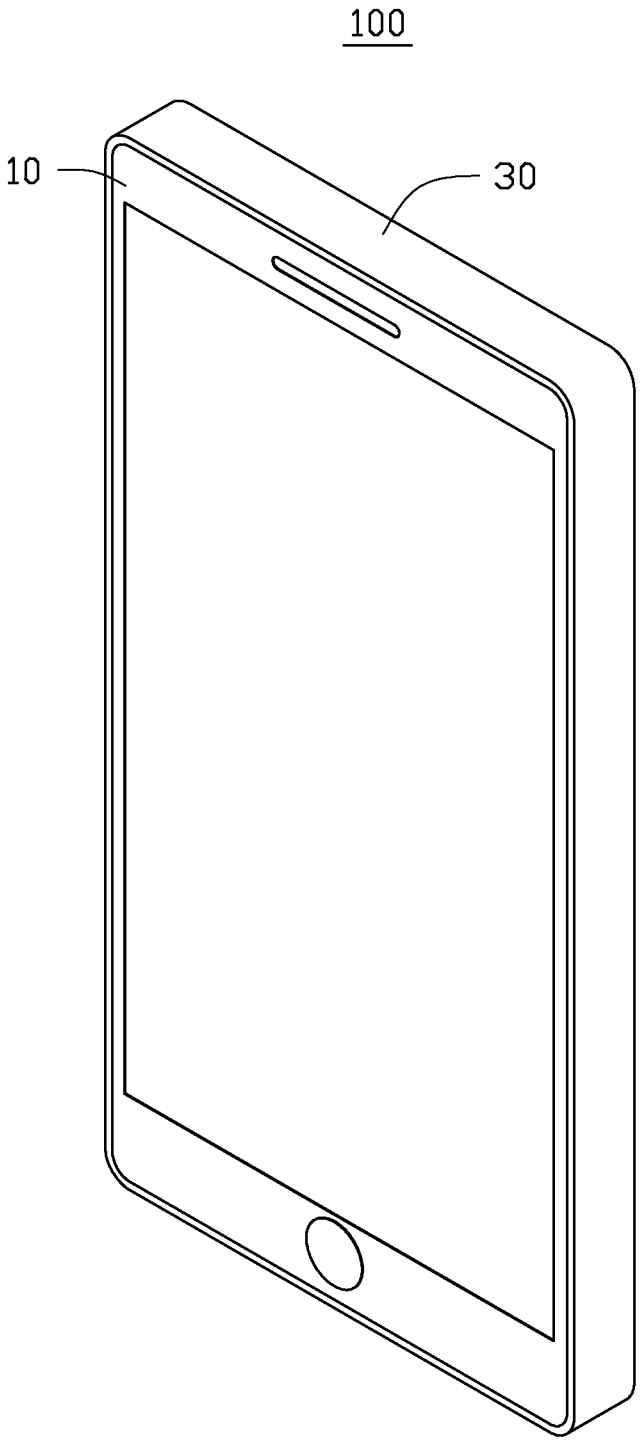
FIG. 1 is an isometric view of an electronic device, according to an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series and the like.

FIG. 1 illustrates that an isometric view of an electronic device 100, according to an exemplary embodiment. The electronic device 100 can be, but not limited to, a mobile phone, a personal digital assistant, or a panel computer. In this exemplary embodiment, the electronic device 100 is a mobile phone, for example. The electronic device 100 includes a window portion 10 and a housing 30. The window portion 10 and the housing 30 are assembled together. The window portion 10 is assembled to the housing 30 and forms a receiving chamber with the housing 30, configured for receiving electronic elements such as a battery.

Figure 2:
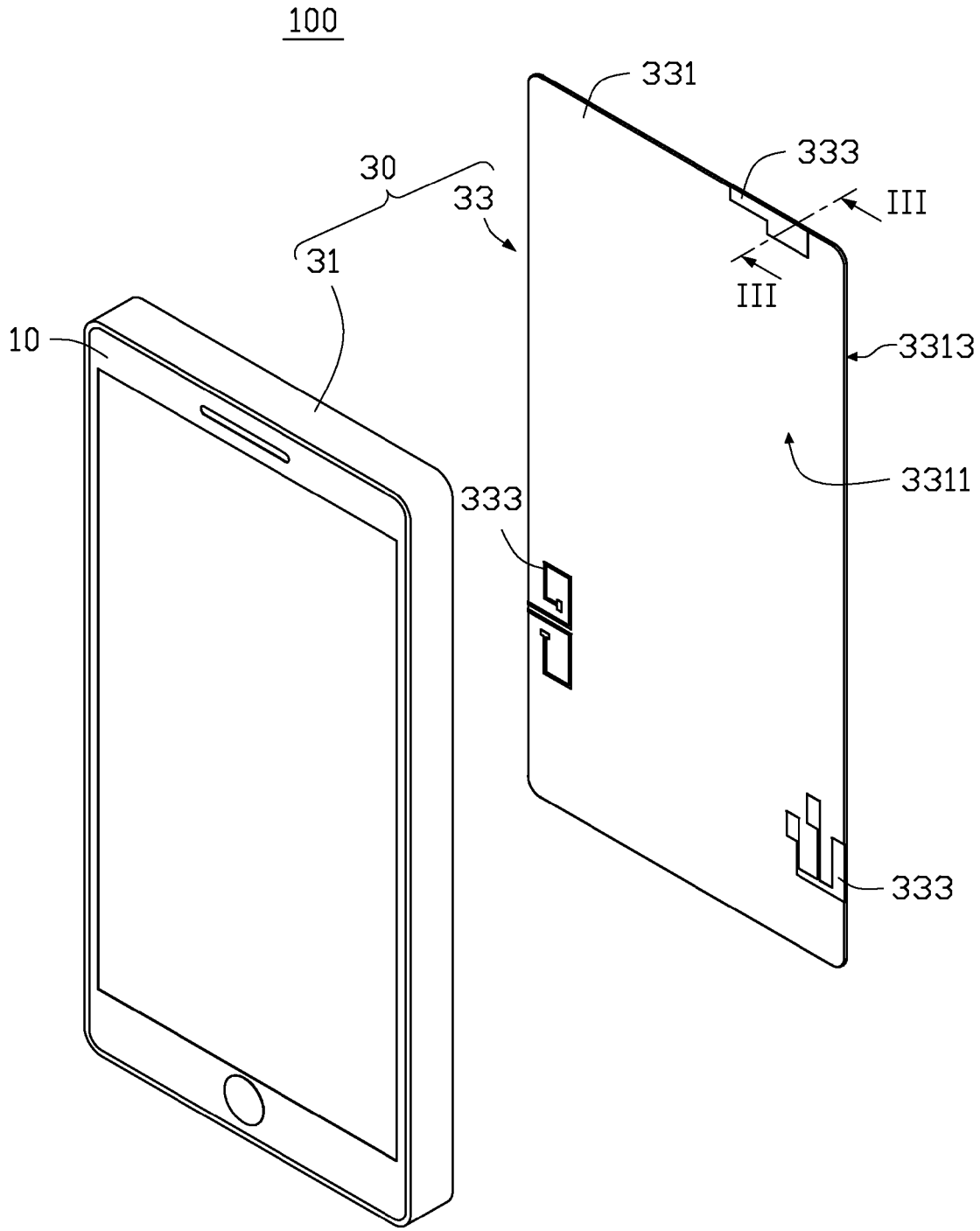
FIG. 2 is an exploded view of the electronic device of FIG. 1.

FIG. 2 illustrates that the housing 30 includes a frame 31 and a cover 33. The frame 31 is sandwiched between the cover 33 and the window portion 10. The frame 31 can be made of metal, plastic, glass, or ceramic material.

The cover 33 covers one side of the frame 31 opposite to the window portion 10. The cover 31 includes a base 331 and an antenna coating layer 333 formed on the base 331. The base 331 includes a first surface 3311 facing the window portion 10 and a second surface 3313 opposite to the first surface 3311.

The antenna coating layer 333 is formed on the first surface 3311. The antenna coating layer 333 is made of metal power by low pressure cold spraying. The metal power can be selected from one of copper power, copper alloy power, copper and nickel mixed power. The antenna coating layer 333 includes a certain pattern which can be adjusted according to requirements. A thickness of the antenna coating layer is about 20 um-50 um.

Figure 3:
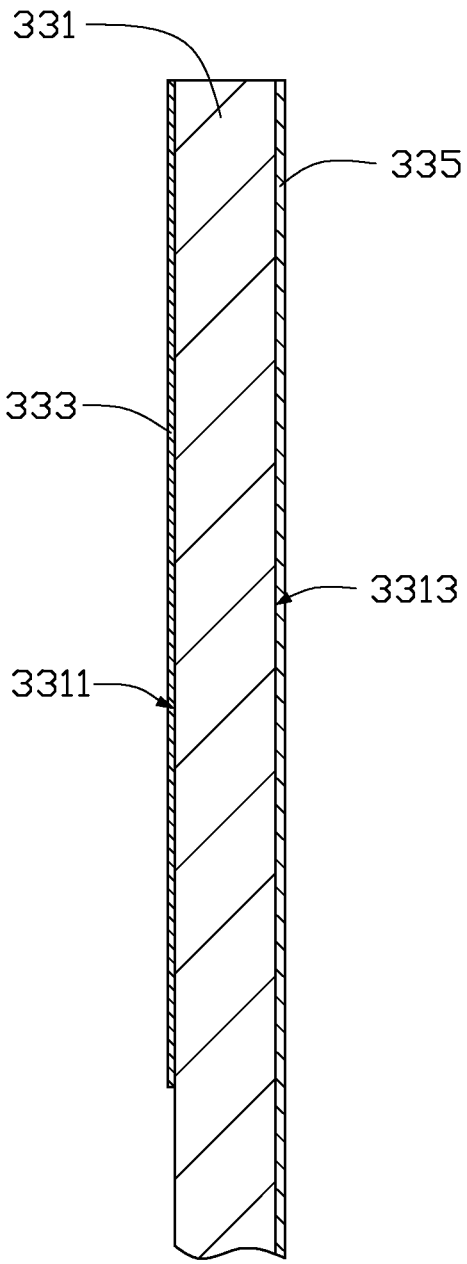
FIG. 3 is a cross-sectional view of the electronic device along line III-III of FIG. 2.

FIG. 3 illustrates that, the cover 33 further includes a decorative layer 335. The decorative layer 335 is formed on the second surface 3313 so that the base 331 can obtain a better appearance. The decorative layer 335 can be formed by painting, printing, spraying, sticking film and so on.

Figure 4:
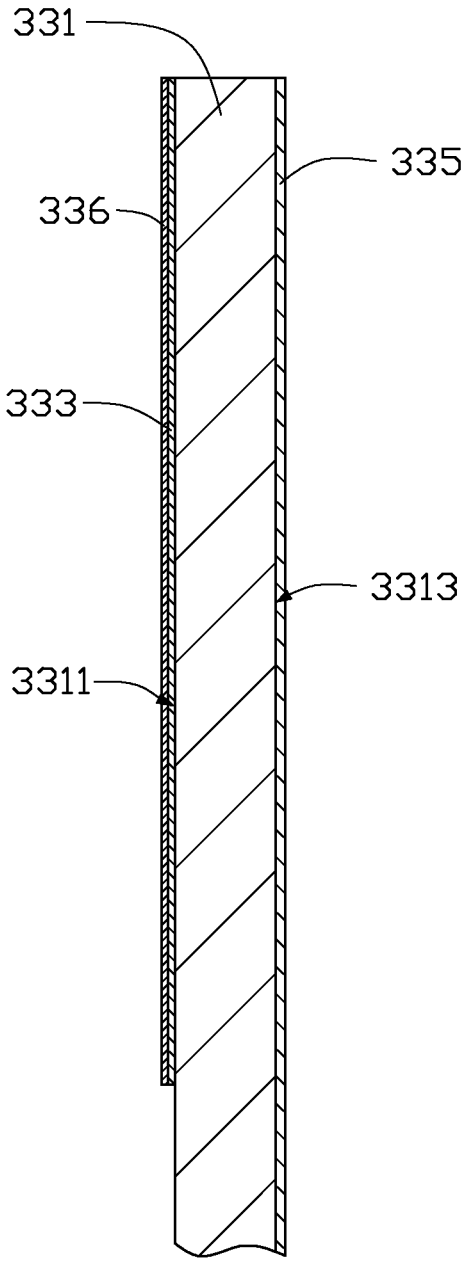
FIG. 4 is a cross-sectional view of the electronic device of FIG. 2, showing the cover further includes a protective layer.

FIG. 4 illustrates that, in other exemplary embodiment, the cover 33 can further include a protective layer 336 coated on the antenna coating layer 333 to protect the antenna coating layer 333 during using. The protective layer 336 can be made of non-conductive material so that the protective layer 336 can have little or no effect on performance of the antenna coating layer 333. The protective layer 336 can be also formed on other surface of the first surface 3311 not covered by the antenna coating layer 333.

Figure 5:
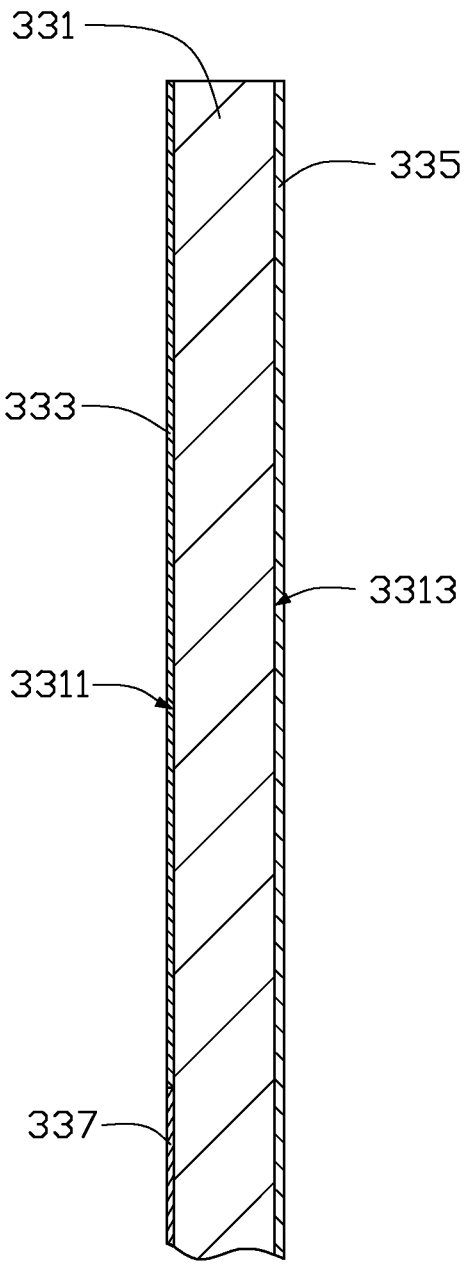
FIG. 5 is a cross-sectional view of the electronic device of FIG. 2, showing the cover further includes a shielding layer.

FIG. 5 illustrates that, in other exemplary embodiment, the cover 33 can further include a shielding layer 337 formed on the first surface 3311. In this exemplary embodiment the shielding film 337 is pasted on the first surface 3311. The shielding layer 337 includes a hollowed-out area. A shape of the hollowed-out area is corresponding to a pattern of the antenna coating layer 333. The shielding layer 337 is made of polyimide.

An exemplary method for making the housing 10 of the electronic device 100 can include the following steps.

A base 331 is provided. The base 331 has a shape of the electronic device 100. The base 331 can be made of glass or ceramic material. The base 31 includes a first surface 3311 and a second surface 3313 opposite to the first surface 3311.

A shielding layer 337 is formed on the first surface 3311. In this exemplary embodiment, the shielding film 337 is pasted on the first surface 3311. The shielding layer 337 includes a hollowed-out area. A shape of the hollowed-out area is corresponding to a pattern of the antenna coating layer 333. The shielding layer is made of polyimide.

An antenna coating layer 333 is formed on the first surface 3311. In this exemplary embodiment, metal power is placed in a cold spraying device (not shown). The metal power can be selected from one of copper power, copper alloy power, copper and nickel mixed power. A grain diameter of the metal power is about 10 um-50 um. Low pressure air is supplied to the cold spraying device. The air is no oil and no pollution air. Air pressure is about 0.5-0.8 Mpa. In this exemplary embodiment, the air pressure is about 0.6 Mpa. An value of air flowing over the cold spraying device is about 300-600 L/min. In this exemplary embodiment, the value of air flowing over the cold spraying device is about 400 L/min. The base 331 and the cold spraying device are fixed. The first surface 3311 of the base 331 is sprayed by cold spraying so that the antenna coating layer 333 is formed in the hollowed-out area by the metal power. A thickness of the antenna coating layer 333 is about 20 um-50 um.

The shielding layer 337 is removed so that the antenna coating layer 333 is exposed from the first surface 3311. In this exemplary embodiment, the shielding layer 337 can be directly and manually removed.

A decorative layer 335 can be formed on the second surface 3313 so that the housing 30 is made. The decorative layer 335 can be formed by painting, printing, spraying, sticking film and so on.

In other exemplary embodiment, a protective layer 336 is formed on the first surface 3311. The protective layer 336 can be formed by painting or sticking film. The protective layer 336 covers at least a surface of the antenna coating layer 333 to protect the antenna coating layer 333.

In other exemplary embodiment, the base 331 formed with the antenna coating layer 333 can be assembled to a housing as an embedding member or a decorative member.

The antenna coating layer 333 is formed on the base 30 made of glass or ceramic by cold spraying. Thus, a better conduction of the antenna coating layer 333 can be ensured and a carrier of the antenna coating layer 333 (i.e. the base 30) can directly serve as an appearance member and has a glass or ceramic appearance. In addition, the antenna coating layer 333 is formed in the low pressure condition (e.g. 0.5-0.8 Mpa as descried in this exemplary embodiment) so that a thickness of the housing 30 can be thinner. Furthermore, the process of manufacturing the housing 30 is simpler and the cost of the housing 30 is relative lower.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A housing comprising:

a base comprising a first surface, the base made of one of glass and ceramic; and an antenna coating layer formed on the first surface, the antenna coating layer made of metal powder, the metal powder selected from one of copper alloy powder, or copper and nickel mixed powder; and wherein a grain diameter of the metal powder is 10 um-50 um, a thickness of the antenna coating layer is 20 um-50 um.

2. The housing of claim 1, further comprising a protective layer formed on the first surface, wherein the protective layer covers at least a surface of the antenna coating layer.

3. The housing of claim 1, further comprising a decorative layer, wherein the base further comprises a second surface opposite to the first surface, the decorative layer formed on the second surface.

4. A method of making a housing comprising:

providing a base made of one of glass and ceramic, the base comprising a first surface;

forming a shielding layer on the first surface, the shielding layer comprising a hollowed-out area;

spraying metal powder on the shielding layer by cold spraying, and forming an antenna coating layer in the hollowed-out area, wherein a grain diameter of the metal powder is 10 um-50 um and a thickness of the antenna coating layer is 20 um-50 um; wherein the metal powder selected from one of copper alloy powder, or copper and nickel mixed powder; and removing the shielding layer to form the housing.

5. The method of claim 4, wherein the step of spraying metal powder on the shielding layer by cold spraying comprising:

placing the metal powder in a cold spraying device;

supplying low pressure air to the cold spraying device, wherein air pressure is about 0.5-0.8 Mpa, an value of air flowing over the cold spraying device is about 300-600 L/min; and fixing the base and the cold spraying device to form the antenna coating layer.

6. The method of claim 4, after the step of forming the antenna coating layer, further comprising:

forming a decorative layer on a second surface of the base opposite to the first surface by one of painting, printing, spraying, and sticking film.

7. The method of claim 4, after the step of forming the antenna coating layer, further comprising:

forming a protective layer on the antenna coating layer by one of painting and sticking film.

8. An electronic device, comprising:

a window portion; and a housing assembled to the window portion, the housing comprising:

a base comprising a first surface, the base made of one of glass and ceramic; and an antenna coating layer formed on the first surface, the antenna coating layer made of metal powder, the metal powder selected from one of, copper alloy powder, copper and nickel mixed powder; and wherein a grain diameter of the metal powder is 10 um-50 um, a thickness of the antenna coating layer is 20 um-50 um.

9. The electronic device of claim 8, further comprising a protective layer formed on the first surface, wherein the protective layer covers at least a surface of the antenna coating layer.

10. The electronic device of claim 8, further comprising a decorative layer, wherein the base further comprises a second surface opposite to the first surface, the decorative layer formed on the second surface.

* * * * *